US012331598B2

(12) United States Patent
Wheater et al.

(10) Patent No.: US 12,331,598 B2
(45) Date of Patent: Jun. 17, 2025

(54) WIRELINE STANDOFF

(71) Applicants: Guy Wheater, Scarborough (GB); Stuart Huyton, Moray (GB)

(72) Inventors: Guy Wheater, Scarborough (GB); Stuart Huyton, Moray (GB)

( * ) Notice: Subject to any disclaimer, the term of this patent is extended or adjusted under 35 U.S.C. 154(b) by 0 days.

(21) Appl. No.: 18/239,649

(22) Filed: Aug. 29, 2023

(65) Prior Publication Data

US 2023/0407713 A1 Dec. 21, 2023

Related U.S. Application Data

(63) Continuation of application No. 17/576,223, filed on Jan. 14, 2022, now Pat. No. 11,739,597, which is a continuation of application No. 16/357,398, filed on Mar. 19, 2019, now Pat. No. 11,255,135, which is a continuation of application No. 15/704,795, filed on Sep. 14, 2017, now Pat. No. 10,267,100, which is a continuation of application No. 14/551,928, filed on Nov. 24, 2014, now Pat. No. 9,777,541, which is a continuation of application No. 13/008,337, filed on Jan. 18, 2011, now Pat. No. 8,919,436.

(60) Provisional application No. 61/296,530, filed on Jan. 20, 2010.

(51) Int. Cl.
*E21B 17/10* (2006.01)
*E21B 17/20* (2006.01)

(52) U.S. Cl.
CPC ..... *E21B 17/10* (2013.01); *E21B 17/206* (2013.01)

(58) Field of Classification Search
CPC ..... E21B 17/10; E21B 17/206; E21B 31/00; E21B 31/107; E21B 31/113; E21B 31/1135
See application file for complete search history.

(56) References Cited

U.S. PATENT DOCUMENTS 3,125,382 A 3/1964 Herndon, Jr. et al.
3,692,109 A 9/1972 Grayson
4,007,798 A * 2/1977 Gazda ..... E21B 31/113 175/297

(Continued)

FOREIGN PATENT DOCUMENTS

CA 1062154 A 9/1979
GB 2393984 A 4/2004
GB 2450918 A * 1/2009 ..... E21B 17/10

OTHER PUBLICATIONS

UK Intellectual Property Office Search Report for Application No. GB0713550.2 dated Mar. 12, 2008.

(Continued)

*Primary Examiner* — Caroline N Butcher
(74) *Attorney, Agent, or Firm* — Tumey L.L.P.

(57) ABSTRACT

A wireline standoff that may ameliorate the effects of wireline cable differential sticking, wireline cable key seating, and high cable drags by reducing or eliminating contact of the wireline cable with the borehole wall during the logging operation. An embodiment includes a wireline standoff. The wireline standoff may comprise a pair of opposing assemblies. The opposing assemblies may each comprise a half shell, a cable insert configured to be disposed in the half shell, and external fins coupled to the half shell. The wireline standoff may further comprise one or more fasteners configured to couple the opposing assemblies to one another.

9 Claims, 6 Drawing Sheets

(56) References Cited

U.S. PATENT DOCUMENTS

| | | | | |
|---|---|---|---|---|
| 4,924,549 | A | 5/1990 | Morel et al. | |
| 4,941,349 | A | 7/1990 | Walkow et al. | |
| 5,941,312 | A * | 8/1999 | Vermeeren | E21B 17/1071 166/241.2 |
| 7,048,064 | B1 | 5/2006 | Smith | |
| 7,255,165 | B2 | 8/2007 | Abdo et al. | |
| 8,919,436 | B2 | 12/2014 | Wheater et al. | |
| 10,267,100 | B2 | 4/2019 | Wheater et al. | |
| 2001/0020530 | A1 | 9/2001 | Eaton | |
| 2009/0058675 | A1* | 3/2009 | Sugiura | E21B 17/028 340/854.6 |

OTHER PUBLICATIONS

USPTO Non-Final Office Action for U.S. Appl. No. 14/551,928 dated Nov. 30, 2016.
USPTO Non-Final Office Action for U.S. Appl. No. 14/551,928 dated Dec. 4, 2015.
USPTO Final Office Action for U.S. Appl. No. 14/551,928 dated Jul. 26, 2016.
USPTO Notice of Allowance for U.S. Appl. No. 14/551,928 dated Jun. 1, 2017.
USPTO Non-Final Office Action for U.S. Appl. No. 13/008,337 dated Mar. 13, 2014.
USPTO Non-Final Office Action for U.S. Appl. No. 13/008,337 dated Apr. 8, 2013.
USPTO Final Office Action for U.S. Appl. No. 13/008,337 dated Oct. 22, 2013.
USPTO Notice of Allowance for U.S. Appl. No. 13/008,337 dated Aug. 22, 2014.
USPTO Issue Notification for U.S. Appl. No. 13/008,337 dated Dec. 10, 2014.
USPTO Issue Notification for U.S. Appl. No. 14/551,928 dated Sep. 13, 2017.
USPTO Notice of Allowance for U.S. Appl. No. 15/704,795 dated Dec. 12, 2018.
USPTO Notice of Allowance for U.S. Appl. No. 15/704,795 dated Sep. 7, 2018.
USPTO Issue Notification for U.S. Appl. No. 15/704,795 dated Apr. 3, 2019.
USPTO Non-Final Office Action for U.S. Appl. No. 15/704,795 dated Mar. 6, 2018.
USPTO Notice of Allowance for U.S. Appl. No. 16/357,398 dated Oct. 14, 2021.
USPTO Non-Final Office Action for U.S. Appl. No. 16/357,398 dated Jun. 22, 2021.
USPTO Final Office Action for U.S. Appl. No. 16/357,398 dated Jan. 8, 2021.
USPTO Non-Final Office Action for U.S. Appl. No. 16/357,398 dated Aug. 18, 2020.
USPTO Issue Notification for U.S. Appl. No. 17/576,223 dated Aug. 9, 2023.
USPTO Notice of Allowance for U.S. Appl. No. 17/576,223 dated Apr. 13, 2023.
USPTO Non-Final Office Action for U.S. Appl. No. 17/576,223 dated Sep. 28, 2022.
USPTO Issue Notification for U.S. Appl. No. 16/357,398 dated Feb. 2, 2022.

* cited by examiner

WIRELINE STANDOFF

The present application is a continuation of U.S. patent application Ser. No. 17/576,223, filed Jan. 14, 2022, which is a continuation of U.S. patent application Ser. No. 16/357,398 filed Mar. 19, 2019, which is a continuation of U.S. patent application Ser. No. 15/704,795 filed Sep. 14, 2017, which is a continuation of U.S. application Ser. No. 14/551,928 filed on Nov. 24, 2014, which is a continuation of U.S. application Ser. No. 13/008,337 filed on Jan. 18, 2011, which claims priority to Provisional Application No. 61/296,530, filed on Jan. 20, 2010, entitled "Wireline Standoff," all of which are incorporated herein by reference in their entirety.

FIELD OF THE INVENTION

The present invention relates to wireline logging and, more particularly, in one or more embodiments, the present invention relates to a device for improving wireline cable performance during logging operations in a variety of boreholes.

BACKGROUND

Wireline logging is a common operation in the oil industry whereby down-hole electrical tools may be conveyed on a wireline (also known as an "e-line") to evaluate formation lithologies and fluid types in a variety of boreholes. In certain wells there is a risk of the wireline cable and/or logging tools becoming stuck in the open hole due to differential sticking or key-seating, for example.

Key-seating may occur when the wireline cable cuts a groove into the borehole wall. For instance, this can happen in deviated or directional wells where the wireline cable may exert considerable sideways pressure at the contact points with the borehole. Since the logging tool diameter is generally much bigger than the groove cut by the wireline cable, a keyseat can terminate normal ascent out of the borehole and potentially result in a fishing job or lost tools in hole.

Differential sticking may occur when there is an overbalance between hydrostatic and formation pressures in the borehole, the severity of which may be related to a number of issues, including: (1) the degree of overbalance and the presence of any depleted zones in the borehole; (2) the character and permeability of the formations bisected by the borehole; (3) the deviation of the borehole, since the sideways component of the tool weight adds to the sticking forces; (4) the drilling mud properties in the borehole, since the rapid formation of thick mud cakes can trap logging tools and the wireline cable against the borehole wall; and (5) the geometry of the toolstring being logged on wireline, since a long and large toolstring presents a larger cross sectional area and results in proportionally larger sticking forces. Additionally, during wireline formation sampling, the logging tools and wireline may remain stationary over permeable zones for a long period of time which also increases the likelihood of differential sticking.

SUMMARY

An embodiment includes a wireline standoff. The wireline standoff may comprise a pair of opposing assemblies. The opposing assemblies may each comprise a half shell, a cable insert configured to be disposed in the half shell, and external fins coupled to the half shell. The wireline standoff further may comprise one or more fasteners configured to couple the opposing assemblies to one another.

Another embodiment includes a wireline assembly. The wireline assembly may comprise a wireline cable and a wireline standoff. The wireline standoff may comprise a pair of opposing assemblies, wherein each of the opposing assemblies may comprise a half shell, a cable insert disposed in the half shell, and external fins coupled to the half shell. The cable insert for each of the opposing assemblies may be coupled to the wireline cable.

Yet another embodiment may comprise a method for reducing sticking in wireline logging. The method may comprise coupling one or more wireline standoffs to a wireline cable. The one or more wireline standoffs may comprise a pair of opposing assemblies, wherein each of the opposing assemblies may comprise a half shell, a cable insert configured to be disposed in the half shell, and external fins coupled to the half shell.

The features and advantages of the present invention will be readily apparent to those skilled in the art. While numerous changes may be made by those skilled in the art, such changes are within the spirit of the invention.

BRIEF DESCRIPTION OF THE DRAWINGS

These drawings illustrate certain aspects of the present invention and should not be used to limit or define the invention.

DETAILED DESCRIPTION

The present invention relates to wireline logging and, more particularly, in one or more embodiments, the present invention relates to a device for improving wireline cable performance during logging operations in a variety of boreholes.

There may be several potential advantages to the devices and methods of the present invention, only some of which may be alluded to herein. One of the many potential advantages of the present invention is that the present invention may ameliorate the effects of differential sticking and/or key-seating of the wireline cable by reducing or eliminating direct contact of the cable to the borehole wall. In accordance with present embodiments, this may be achieved by coupling a plurality of wireline standoffs onto the wireline cable, resulting, for example, in a lower contact area per unit length of open hole, lower applied sideways pressure of the wireline against the borehole wall, and/or lower cable drag when conveying the wireline in or out of the hole. Another potential advantage is the use of wireline standoffs may also enable more efficient use of wireline jars in the logging string since the standoffs should reduce the cable friction above the jars, allowing firing at lower surface tensions and easier re-rocking of the jars in boreholes where high cable drag is a problem (attenuating the applied surface tension before it can reach the wireline cable head and jars).

Figure 1:
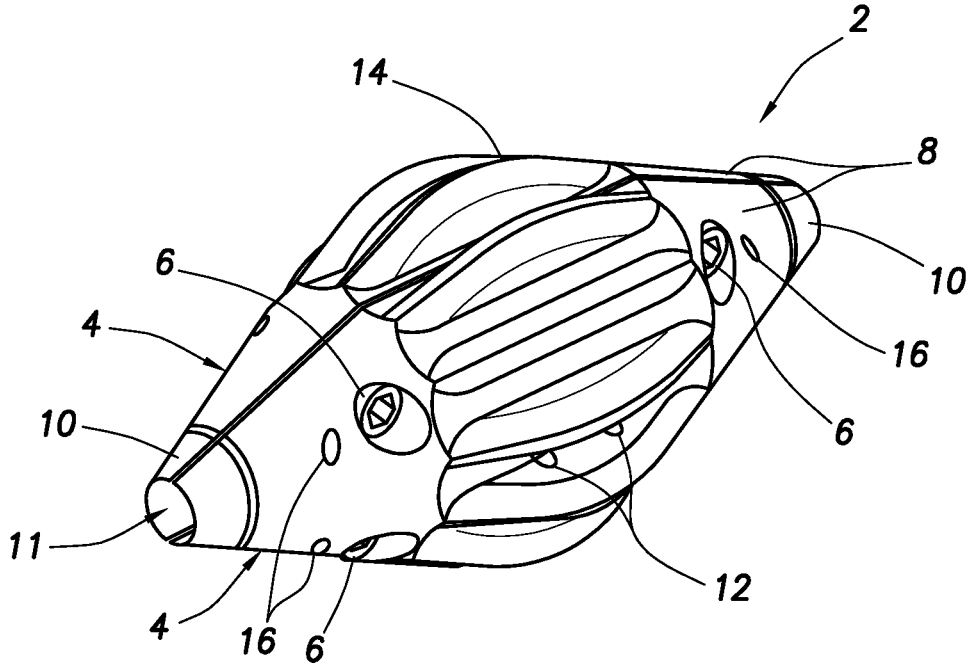
FIG. 1 is an isometric view of a wireline standoff in accordance with one embodiment of the present invention.

Referring now to FIG. 1, a wireline standoff 2 is illustrated in accordance with one embodiment of the present invention. In accordance with present embodiments, the wireline standoff 2 may comprise two opposing assemblies 4 which mate together onto the wireline cable. A variety of different fasteners may be used to couple the two assemblies 4 to one another. By way of example, bolts, dowel pins, and combinations thereof may be used. In an embodiment, a combination of dowel pins (illustrated, e.g., by reference number 54 on FIG. 6) and bolts 6 may be used to couple the assemblies 4 to one another. In one particular embodiment, four cap head bolts 6 and four dowel pins 54 may be used for coupling the assemblies 4. The dowel pins 54 may be used, for example, to resist shear forces. In an embodiment, the dowel pins 54 are 4×8 mm pins.

As illustrated, each of the opposing assemblies 4 may comprise a corresponding half shell 8 which contains a cable insert 10. In the illustrated embodiment, the wireline standoff 2 contains two cable inserts 10 with each of the opposing assemblies 4 contains a corresponding cable insert 10. In an embodiment, the cable inserts 10 may be secured in their half shells 8 by a fastener, such as, for example, recessed cap head bolt 12. In an embodiment, contact with the wireline cable exterior may be solely with the cable inserts 10 and not the half shells 8. In one particular embodiment, the cable inserts 10 may be configured to clamp directly onto the wireline cable using the bolts 6. In general, the cable inserts 10 should mate to form a central bore 11 through the wireline standoff 2 in accordance with certain embodiments. The cable inserts 10 may be configured to slightly deform around the outer wireline cable armour during installation without physically damaging the wireline cable. There are a large range of cable inserts 10 available to fit the wireline cable, taking into account any manufacturing tolerances and varying degrees of wear or distortion along the length of the wireline cable. Therefore, for a plurality of wireline standoffs 2 installed on the wireline cable, a range of different cable inserts 10 may be employed, for example, to ensure a fit which should not allow slippage along the wireline cable or damage to the wireline cable when coupled. The bolts 6 that can be used to couple the two assemblies 4 together may be torqued to a consistently safe limit with a calibrated torque wrench.

The half shells 8 may comprise a suitable material, such as stainless steel or other high performance material. In an embodiment, the half shells 8 may constructed from stainless steel. In addition, the half shells 8 may be surface hardened (e.g., vacuum hardened), in certain embodiments, for improved wear resistance during use. A wide range of shell sizes are available for installation on the wireline, from an outside diameter of about 50 mm and greater, for example. In an embodiment, the half shells 8 may have an outside diameter of about 75 mm. In an embodiment, the maximum external diameter of the wireline standoff 2 is less than the size of the internal diameters of the overshot and drill pipe that may be used in fishing operations so that the wireline standoff 2 can safely fit inside a fishing assembly enabling the wireline cable head or tool body to be successfully engaged by the fishing overshot. In this manner, the wireline cable and wireline standoff 2 may then be safely pulled through the drill pipe to the surface when the cable head is released from the logging string.

The cable inserts 10 may comprise a suitable material, such as aluminum. In an embodiment, the cable inserts 10 may be construed from aluminum. In an embodiment, the cable inserts 10 are disposable. Furthermore, in some embodiments, the cable inserts 10 may be positively secured into each of the half shells 8 by fasteners 12 (e.g., small cap head bolts) that pass through the outside of each of the half shells 8 into tapped holes in the cable inserts 10. In general, the cable inserts 10 should have no movement inside the half shells 8, in accordance with present embodiments. For example, a central spigot (see, e.g., anti-rotation spigot 64 on FIG. 7) may be included to reduce or even eliminate rotation of the cable inserts 10 in the half shells 8. By way of further example, a central flange (see, e.g., cable insert flange 60 on FIG. 7) on the cable inserts 10 may be used to ensure little to no axial movement in the half shells 8.

The wireline standoff 2 may further include a plurality of fins 14 coupled to the half shells 8. Among other things, the fins 14 may allow easy movement along the borehole and through mud cake and other debris which may have accumulated in the borehole during drilling. In an embodiment, the fins 14 may be arranged along the length of the half shells 8. In an embodiment, the wireline standoff may comprise twelve fins 14. In an embodiment, the fins 14 may be distributed radially along the length of the half shells 8. The empty space between the fins 14 should allow for circulation of drilling mud inside drill pipe if the wireline cable and wireline standoff 2 are fished using drill pipe. In an embodiment, the fins 14 have a low coefficient of friction. The fins 14 may have a smooth radial cross section to minimize the contact area with the borehole wall and allow for standoff rotation under the action of cable torque. It is believed that this should reduce the differential sticking force acted upon each fin at the contact points with the borehole wall and should also allow for easy rotation of the standoffs if the wireline cable rotates when it is deployed and retrieved from the borehole. It should be noted that it is the general nature of wireline cable to rotate during logging operations due to the opposing lay angles of the inner and outer armours which can induce unequal torsional forces when tensions are applied. The design of the wireline standoffs 2 should allow easy rotation of the wireline cable during the logging operation, avoiding, for example, the potential for damage if excessive torque was allowed to build up.

In addition, the wireline standoff 2 may further include a plurality of holes 16 in the half shells 8. In an embodiment, the holes 16 may extend across the half shells for use in installation. By way of example, the holes 16 may be used to connect the wireline standoff 2 to a lanyard during installation to avoid dropped objects on the drill floor during installation on the wireline cable. In an embodiment, each of the half shells 8 may contain four holes 16.

Figure 2:
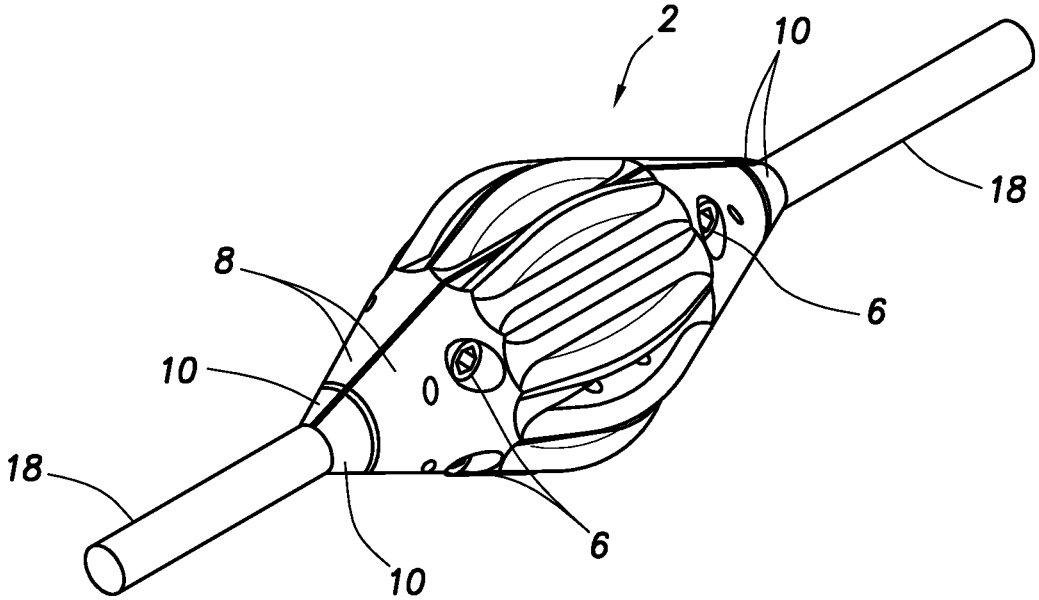
FIG. 2 is an isometric view of a wireline standoff coupled to a section of wireline in accordance with one embodiment of the present invention.

FIG. 2 illustrates a section of a wireline cable 18 passing through the central bore 11 (shown, e.g., on FIG. 1) of the cable inserts 10 in the wireline standoff 2. As illustrated, bolts 6 hold the half shells together 8 while clamping the cable inserts 10 onto the wireline cable 18, in accordance with certain embodiments. The diameter of the wireline cable 18 may vary (e.g., about 10 to about 15 mm), for example, depending on the logging vendor. In an embodiment, the cable inserts 10 may be matched to the diameter of the wireline cable 18 regardless of any variations in size or profile that might occur along the length of the wireline cable 18. As previously mentioned, the cable inserts 10 may comprise aluminum which is considerably softer than the armour material of the wireline cable 18. It is desirable to reduce the risk of damage to the wireline cable 18 during installation of the wireline standoff 2. By way of example, an accurate fit of the cable inserts 10 on the wireline cable 18 and, in certain embodiments, the controlled torque of the bolts 6 during installation should reduce the risk of damage to the wireline cable 18 from the cable inserts 10 when the bolts 6 are tightened, pulling the two half shells 8 together and the cable inserts 10 into contact with the wireline cable 18.

One or more of the wireline standoffs 2 may be used on a wireline cable 18 in accordance with embodiments of the present invention. An embodiment of the present invention includes installation of a plurality of wireline standoffs 2 on the wireline cable 18 to minimize the wireline cable 18 contact over a selected zone(s) of an open-hole section. The wireline standoffs 2 may be installed on the wireline cable 18, for example, to either straddle known permeable zones where differential sticking is a risk (e.g., eliminating cable contact 100%) or they can be placed at regular intervals along the wireline cable 18 to minimize key-seating, taking into account, for example, the dogleg severity of the borehole. For boreholes with higher dogleg severity, the spacing between wireline standoffs 2 on the wireline cable 18 may be reduced. In certain embodiments, the spacing of wireline standoffs 2 on the wireline cable 18 may be from about 10 feet to more than 100 feet, depending on the requirements for the particular borehole being logged.

Figure 3:
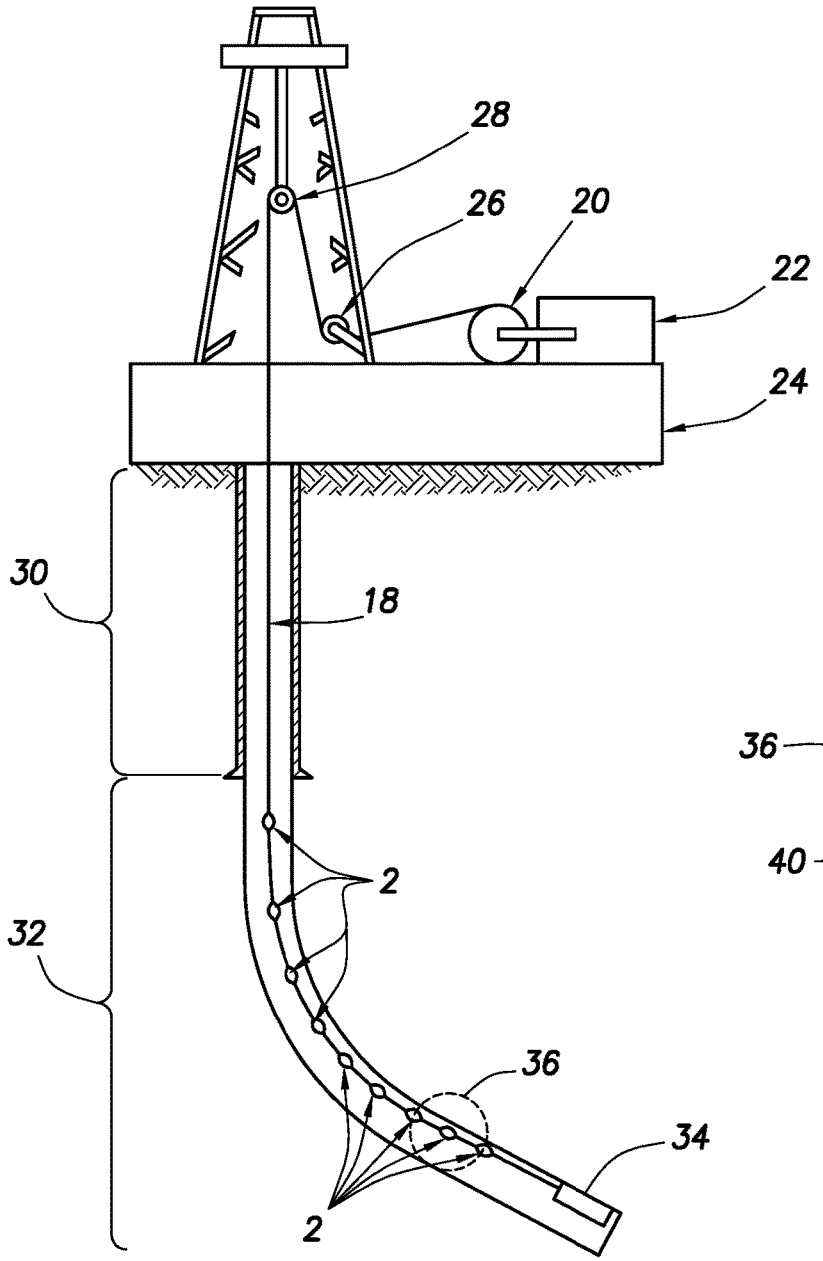
FIG. 3 illustrates a plurality of wireline standoffs installed on a wireline cable in accordance with one embodiment of the present invention.
Figure 4:
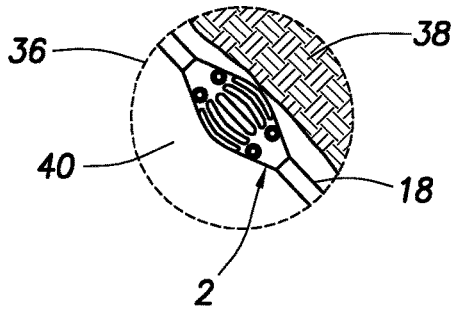
FIG. 4 is a close-up view illustrating a wireline standoff in relation to the borehole wall in accordance with one embodiment of the present invention.

FIG. 3 illustrates a generic logging operation that includes a plurality of wireline standoffs 2 coupled to the wireline cable 18 in accordance with one embodiment of the present invention. As illustrated, a plurality of wireline standoffs 2 may be clamped onto the wireline cable 18. The wireline cable 18 may be, for example, stored on the wireline drum 20 and spooled into the well by a winch driver and logging engineer in the logging unit 22. In the illustrated embodiment, the logging unit 22 is fixed to the drilling rig or platform 24, and the wireline cable 18 is deployed through the derrick via two or three sheaves 26, 28 to the maximum depth of the well. The borehole may have a cased-hole section 30 and an open-hole section 32. As illustrated, the wireline standoffs 2 may be installed on the wireline 18 in the open-hole section 32. A logging tool 34 may be connected to the lower end of the wireline cable 18 to take, for example, the petro-physical measurements or fluid or rock samples in the open-hole section of the borehole. The number of wireline standoffs 2, and their positions on the wireline cable 18 may be determined by a number of factors, including for example, the length of the open-hole section 32, the location of sticky, permeable, or depleted zones, and the overall trajectory of the well, which may be deviated or directional in nature. FIG. 4 is a close-up view illustrating attachment of a wireline standoff 2 to the wireline cable 18 taken along circle 36. In the illustration of FIG. 4, the wireline standoff 2 can be seen in relation to the wireline cable 18, the borehole wall 38, and the borehole 40.

Figure 5:
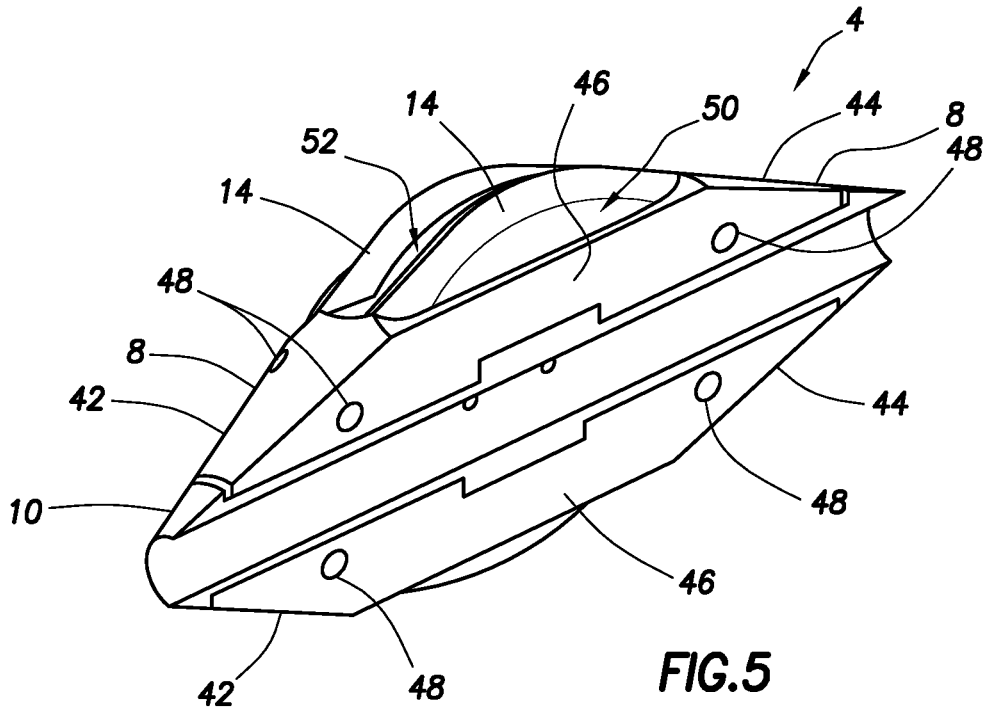
FIGS. 5 and 6 are isometric views of wireline standoffs with one half-shell removed in accordance with embodiments of the present invention.

FIG. 5 illustrates one of the opposing assemblies 4 in accordance with one embodiment of the present invention. As illustrated, the assembly 4 includes a half shell 8 with a cable insert 10 disposed therein. In an embodiment, the half shell 8 includes a front portion 42, a rear portion 44 and a middle portion 46 that interconnects the front portion 42 and the rear portion 44. In the illustrated embodiment, the front portion 42 and the rear portion 44 are each in the shape of a conic section with the middle portion 46 being generally cylindrical in shape. In the illustrated embodiment, the half shell 8 further includes holes 48 through which fasteners (e.g. bolts 6 shown on FIG. 1) may be inserted that secure half shells 8 to one another clamping the cable inserts 10 onto the wireline cable 8. The opposing assembly 4 may further contain fins 14 that extend along the length thereof. As illustrated, each of the fins 14 may in the shape of an arch that spans across at least a portion of the middle portion 46. Accordingly, there may be a gap 50 between the fins 14 and the middle portion 46 with either end of the fins 14 attached to the half shell 8. In addition, the fins 14 may be spaced around the middle portion 46 so that there is a gap 52 between each fin 14.

Figure 6:
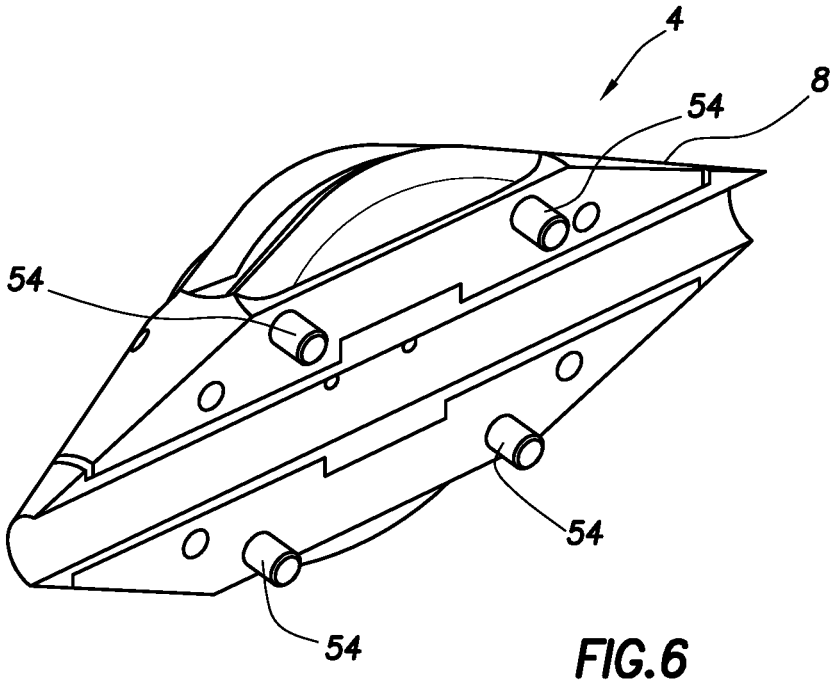

FIG. 6 illustrates an alternate embodiment of the opposing assembly 4 in accordance with one embodiment of the present invention. In the embodiment illustrated in this figure, the half shell 8 further includes dowel pins 54 sized to fit into corresponding holes in the other half shell 8 (not illustrated in FIG. 6). In one particular embodiment, the half shell 8 includes four dowel pins 54. In certain embodiments, the dowel pins 54, in conjunction with the bolts 6 (shown, e.g., on FIG. 1), may, for example, couple the half shells 8 together. As previously mentioned, the dowel pins 54 should assist the wireline standoff 2 in resisting shear stresses.

Figure 7:
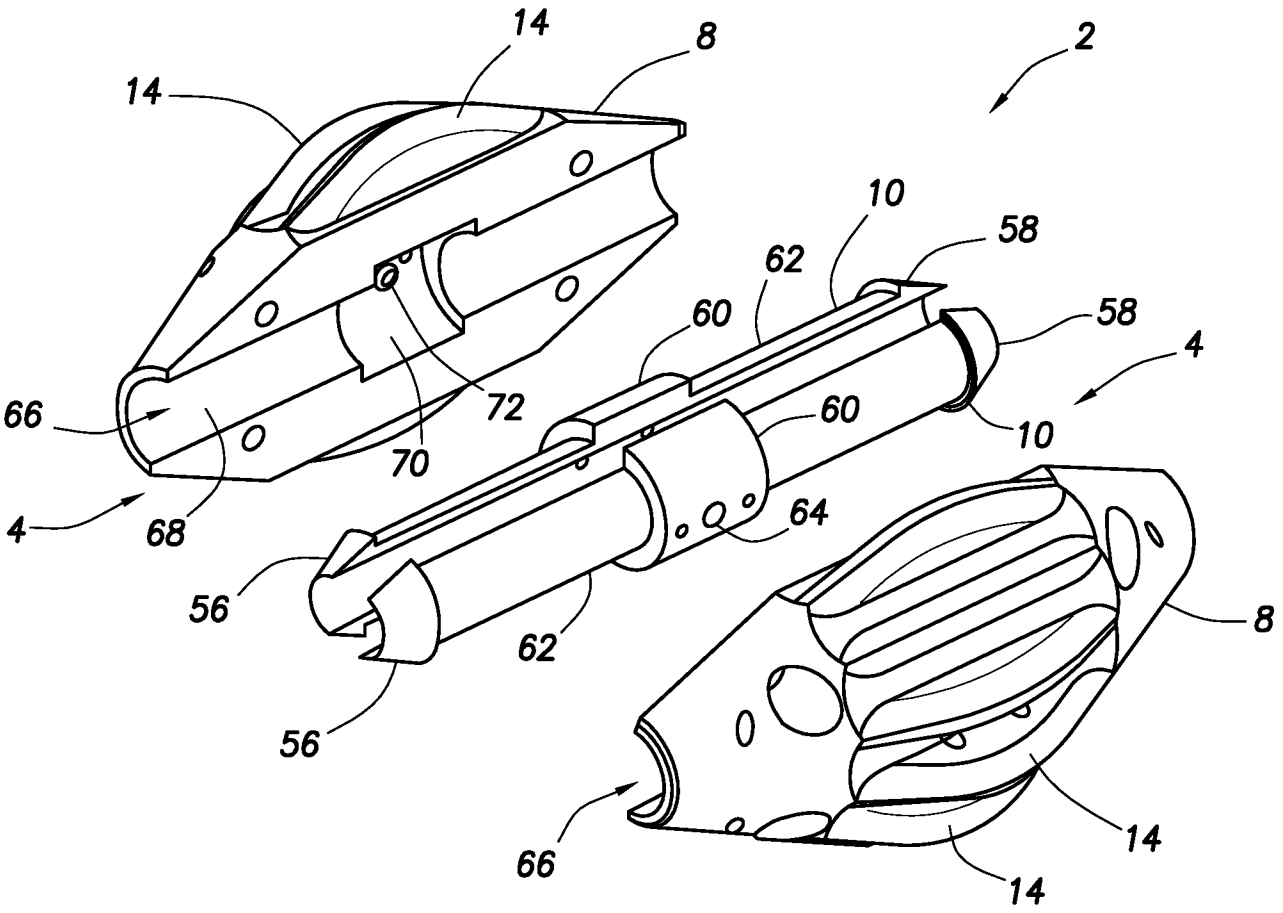
FIGS. 7 and 8 are exploded views of wireline standoffs in accordance with embodiments of the present invention.
Figure 8:
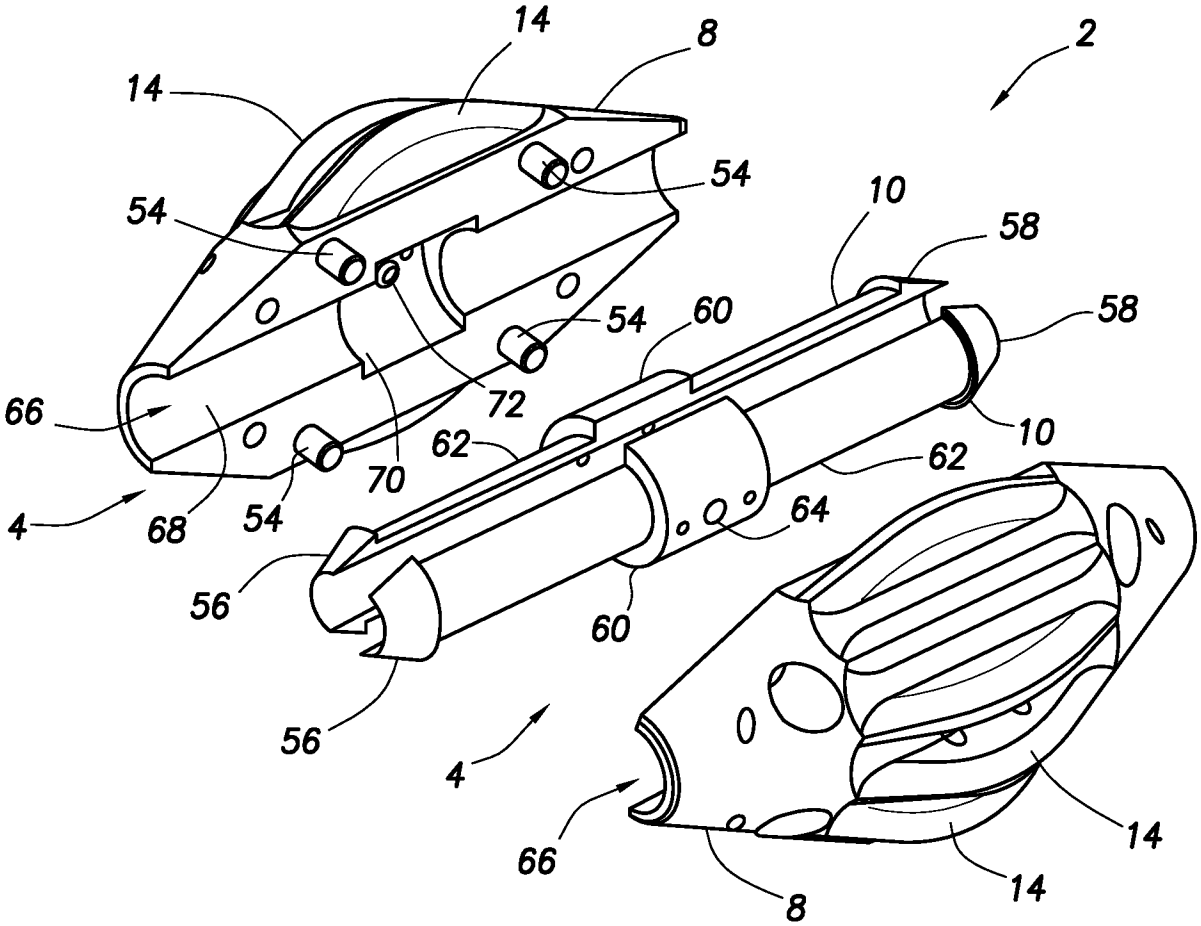

FIGS. 7 and 8 illustrate an exploded view of the wireline standoff 2 in accordance with embodiments of the present invention. As illustrated, the wireline standoff 2 includes opposing assemblies 4 that each comprises a half shell 8, a cable insert 10, and a plurality of fins 14. In the embodiment illustrated in FIG. 8, dowel pins 54 are included in one of the half shells 2 for insertion into corresponding holes (not illustrated) in the other half shell 2. As illustrated, each of the cable inserts 10 may in the general shape of a hollow, half cylinder. Each of the cable inserts 10 may have a first flanged end 56 and a second flanged end 58. As illustrated, the first flanged end 56 and the second flanged end 58 may be tapered. In an embodiment, when assembled, the first flanged end 56 and the second flanged end 58 each may extend beyond the half shells 8 that encase at least a portion of the cable inserts 10. In addition, cable insert flanges 60 may be disposed over at least a portion of a middle portion 62 of each cable insert 10 in accordance with one embodiment. In an embodiment, cable insert flanges 60 are integral with the cable inserts 10. In an embodiment, the cable insert flanges 60 are not integral with the cable inserts 10. An anti-rotation spigot 64 may be formed in one or more of the cable insert flanges 60. As illustrated, each of the half shells 8 includes a through passageway 66 having an inner wall 68. In general, the through passageway 66 in each half shell 8 is sized to receive a corresponding cable insert 10. In one embodiment, the inner wall 68 of the through passageway 66 in each of the half shells 8 may have a cut out 70 that receives the corresponding cable insert flange 60 preventing axial movement of the wireline standoff 2 when installed. In addition, a protrusion 72 may extend from the inner wall in the cut out 70 with the protrusion being sized to fit into the anti-rotation spigot 64 to prevent rotation of the wireline standoff 2. In this manner, cable insert flanges 60 and the anti-rotation spigot 64 may lock the half shells 8 and cable inserts 10.

Figure 9:
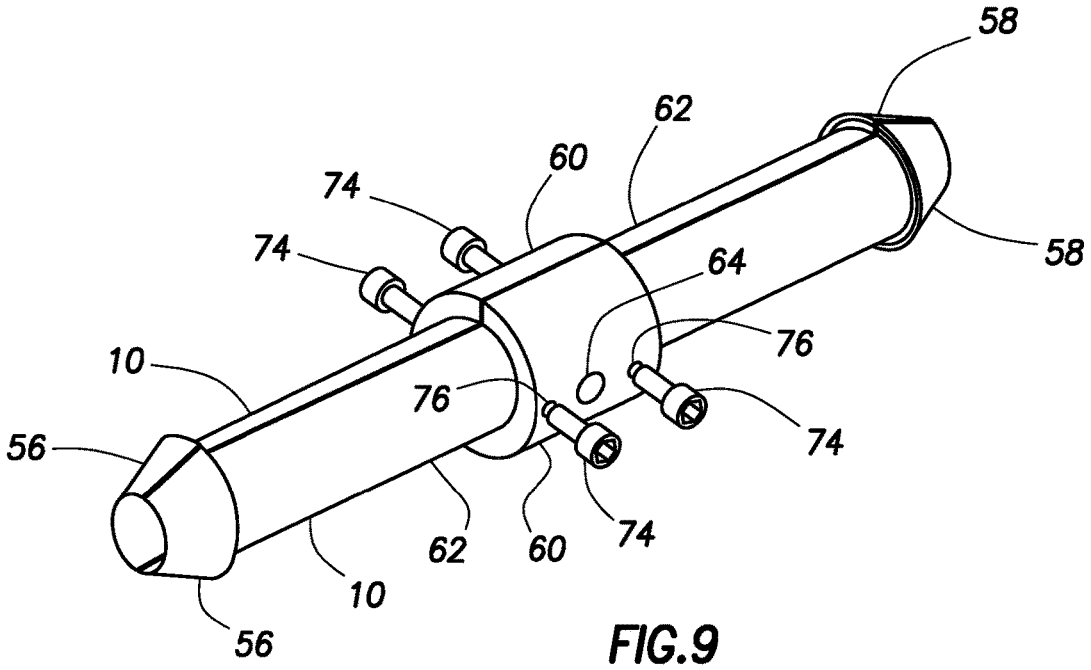
FIG. 9 illustrates cable inserts for use in a wireline standoff in accordance with one embodiment of the present invention.

FIG. 9 illustrates an exploded view of the cable inserts 10 in accordance with one embodiment of the present invention. As illustrated, each cable insert 10 includes a first flanged end 56, a second flanged end 58, and a middle portion 62. As further illustrated, the cable inserts 10 each include a cable insert flange 60 disposed over the middle portion 62 of each cable insert 10. In the illustrated embodiment, the cable insert flanges 60 each include an anti-rotation spigot 64. In one embodiment, fasteners 74, such as small cap head screws, may be used to retain the cable inserts 10 in the half shells 8. As illustrated, the fasteners 74 may be received by openings 76 in the cable insert flanges 60. For example, through holes may be formed in each half shell 8 that extend through the wall of the cutout 70 in the through passageway 66 for receiving the fasteners 74.

Figure 10:
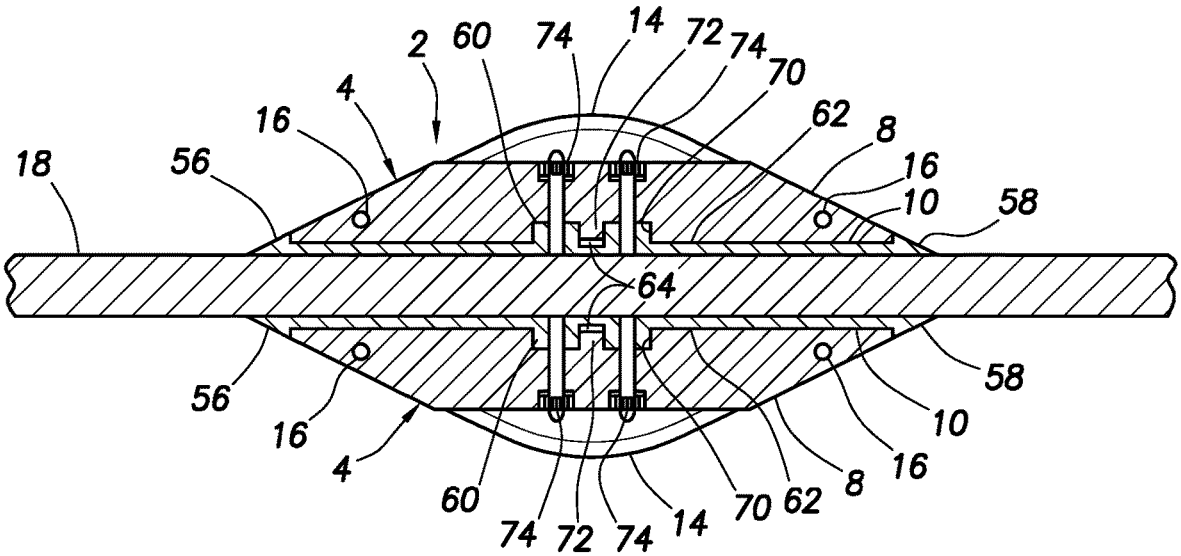
FIG. 10 is a cross-sectional view of a wireline standoff in accordance with one embodiment of the present invention.

FIG. 10 illustrates a cross section of the wireline standoff 2 installed on the wireline cable 18. As illustrated, the wireline standoff 2 includes opposing assemblies 4 that each comprise a half shell 8, a cable insert 10, and a plurality of fins 14. The half shells 8 each comprise holes 16 that may be used, for example, to connect the wireline standoff 2 to a lanyard during installation. In the illustrated embodiment, the cable insert 10 is in contact with the wireline cable 18. As illustrated, each cable insert 10 includes a first flanged end 56, a second flanged end 58, and a middle portion 62 with cable insert flanges 60 disposed over the middle portion 62. In the illustrated embodiment, the first flanged end 56 and the second flanged end 58 each extend beyond the half shells 8. As illustrated, the cable insert flanges 60 may fit into corresponding cut outs 70 in the half shells 8. In one embodiment, a protrusion 72 in the cutouts 70 fits into the anti-rotation spigot 64 of the cable insert flanges 60. As further illustrated, fasteners 74 extend through the half shells 8 and into the cable inserts 10.

Although the present invention and its advantages have been described in detail, it should be understood that various changes, substitutions and alterations may be made herein without departing from the spirit and scope of the invention as defined by the appended claims. Although individual embodiments are discussed, the invention covers all combinations of all those embodiments.

What is claimed is:

1. A wireline assembly, comprising:

a wireline cable;

one or more wireline standoffs located on the wireline cable, wherein each of the one or more wireline standoffs comprises a cable insert disposed between a pair of opposing assemblies, and wherein the cable insert comprises an anti-rotation spigot, and further wherein each of the opposing assemblies comprises a half shell, wherein the half shell comprises a front portion and a rear portion which are connected by a middle portion, wherein the front portion and the rear portion have a conical shape and the middle portion has a cylindrical shape, and further wherein the cable insert comprises two parts, wherein each part of the cable insert is shaped in a hollow, half-cylinder, such that the cable insert parts form a uniform internal diameter matched to a diameter of the wireline cable; and a plurality of external fins, wherein each of the plurality of external fins is coupled to one of the half shells, and further wherein each of the plurality of external fins is in the shape of an arch that spans at least a portion of one of the half shells, and further wherein the plurality of external fins are distributed radially along the length of the half shells and each external fin comprises a smooth radial cross section;

wherein each of the half shells comprises a through passageway having an inner wall, wherein the inner wall comprises a cut out, wherein a protrusion extends from the inner wall.

2. A method of reducing cable friction of a wireline assembly, comprising:

providing the wireline assembly comprising a wireline cable and a plurality of external fins;

securing one or more wireline standoffs to the wireline cable, wherein each of the one or more wireline standoffs comprises a cable insert disposed between a pair of opposing assemblies, wherein the cable insert comprises an anti-rotation spigot, and further wherein each of the opposing assemblies comprises a half shell, wherein the half shell comprises a front portion and a rear portion which are connected by a middle portion, wherein the front portion and the rear portion have a conical shape and the middle portion has a cylindrical shape, and further wherein the cable insert comprises two parts, wherein each part of the cable insert is shaped in a hollow, half-cylinder, such that the cable insert parts form a uniform internal diameter matched to a diameter of the wireline cable, and further wherein each of the plurality of external fins is coupled to one of the half shells, and further wherein each of the plurality of external fins is in the shape of an arch that spans at least a portion of one of the half shells, and further wherein the plurality of external fins are distributed radially along the length of the half shells and each external fin comprises a smooth radial cross section;

conveying the wireline assembly into a borehole; and reducing a cable friction caused by the wireline cable contacting a wall of the borehole, wherein the reducing results from the one or more wireline standoffs lowering an area of contact between the wireline cable and the wall of the borehole.

3. The method of claim 2, further comprising attenuating a tension applied to the wireline cable.

4. The method of claim 2, further comprising preventing key-seating of the wireline assembly.

5. The method of claim 2, further comprising preventing differential sticking of the wireline assembly.

6. A method of assembling a wireline assembly, comprising:

a. disposing the wireline assembly comprising a wireline cable and a plurality of fins into a borehole;

b. placing two parts of a cable insert around the wireline cable, wherein the cable insert comprises an anti-rotation spigot;

c. securing the two parts of the cable insert to each other;

d. placing a pair of opposing assemblies around the cable insert, wherein each of the opposing assemblies comprises a half shell, wherein the half shell comprises a front portion and a rear portion which are connected by a middle portion, wherein the front portion and the rear portion have a conical shape and the middle portion has a cylindrical shape, and further wherein the cable insert comprises two parts, wherein each part of the cable insert is shaped in a hollow, half-cylinder, such that the cable insert parts form a uniform internal diameter matched to a diameter of the wireline cable, and further wherein each of the plurality of external fins is coupled to one of the half shells, and further wherein each of the plurality of external fins is in the shape of an arch that spans at least a portion of one of the half shells, and further wherein the plurality of external fins are distributed radially along the length of the half shells and each external fin comprises a smooth radial cross section;

e. securing the pair of opposing assemblies to each other; and f. repeating steps (b) through (f) at a different location on the wireline cable;

wherein each of the half shells comprises a through passageway having an inner wall, wherein the inner wall comprises a cut out, wherein a protrusion extends from the inner wall.

7. The method of claim 6, herein the location is selected in order to reduce a friction caused by the wireline cable contacting a wall of the borehole.

8. The method of claim 6, wherein the location is selected in order to prevent key- seating of the wireline assembly.

9. The method of claim 6, wherein the location is selected in order to prevent differential sticking of the wireline assembly.

* * * * *